US011313552B2

(12) United States Patent
Wong

(10) Patent No.: US 11,313,552 B2
(45) Date of Patent: Apr. 26, 2022

(54) PROTECTIVE DEVICE AND CANDLE WICK BURNING LAMP ASSEMBLY

(71) Applicant: Fleming International Limited, Hong Kong (HK)

(72) Inventor: Man Chit Wong, Hong Kong (HK)

(73) Assignee: Fleming International Limited, Hong Kong (HK)

( * ) Notice: Subject to any disclaimer, the term of this patent is extended or adjusted under 35 U.S.C. 154(b) by 22 days.

(21) Appl. No.: 17/081,210

(22) Filed: Oct. 27, 2020

(65) Prior Publication Data

US 2021/0404651 A1 Dec. 30, 2021

(30) Foreign Application Priority Data

Jun. 30, 2020 (CN) ..... 202021263355.7

(51) Int. Cl.
*F23D 3/16* (2006.01)
*F21S 13/00* (2006.01)

(52) U.S. Cl.
CPC ..... *F23D 3/16* (2013.01); *F21S 13/00* (2013.01)

(58) Field of Classification Search
CPC ..... F21S 13/00; F23D 3/16
USPC ..... 431/288–297
See application file for complete search history.

(56) References Cited

U.S. PATENT DOCUMENTS 3,759,478 A * 9/1973 Schmitt ..... C11C 5/021 249/93
3,799,492 A * 3/1974 O'Laughlin ..... C11C 5/023 249/94
4,004,773 A * 1/1977 Binder ..... C11C 5/023 249/93
6,863,525 B2 * 3/2005 Byrd ..... C11C 5/006 431/289

* cited by examiner

*Primary Examiner* — Vivek K Shirsat

(57) ABSTRACT

A protective device and a candle wick burning lamp assembly are provided, wherein the candle wick burning lamp includes a container and a candle wick structure. The candle wick structure includes a candle wick body and a support base fixed with one end of the candle wick body. The support base is placed at a bottom of the container. The bottom of the container is in a circular structure. The protective device includes a central portion and a branch portion. The branch portion is connected to the central portion. A length of the branch portion is 0.7 to 1 time a radius of the circular structure. At least two branch portions are arranged. At least one of the at least two branch portions and/or the central portion are provided with a through hole. The through hole allows the candle wick body to pass through.

20 Claims, 11 Drawing Sheets

PROTECTIVE DEVICE AND CANDLE WICK BURNING LAMP ASSEMBLY

CROSS-REFERENCE TO RELATED APPLICATIONS

The present disclosure claims priority to Chinese Patent Application No. 202021263355.7, filed with the Chinese Patent Office on Jun. 30, 2020, titled "PROTECTIVE DEVICE AND CANDLE WICK BURNING LAMP ASSEMBLY", the entire contents of which are incorporated herein by reference.

TECHNICAL FIELD

Embodiments of the present disclosure relate to the technical field of lighting technologies, and in particular, relate to a protective device and a candle wick burning lamp assembly.

BACKGROUND

Candle wick burning lamps are widely used in backup illumination after power interruption, and some special atmosphere creation scenarios.

Generally, a candle wick burning lamp includes a container and a candle wick structure. The container includes a bottom and a side wall surrounding the bottom. The candle wick structure includes a candle wick body and a support base fixed with one end of the candle wick body. The support base is fixed by adhesive to the bottom of the container. The candle wick body is surrounded by the side wall of the container.

However, during use of the above candle wick burning lamp, especially in the event of exhaust of the candle wick body, the heat produced by burning may melt the adhesive for fixing the support base. As a result, it is hard to retain the support base at a predetermined position of the bottom of the container. For example, the support base would be close to the side wall of the container, and a burning end of the candle wick body approaches or even contacts the side wall of the container, such that the burning of the candle wick body is affected, or even the container is broken due to uneven heating, which may result in dangers. One solution is to press the support base with a circular iron cover and let the candle wick body go through holes at the proper position of the circular iron cover. However, the circular iron cover wastes materials, and the weight of such a product is greatly increased. Additionally the circular iron cover is not convenient to install or take out.

SUMMARY

An embodiment of the present disclosure provide a protective device for a candle wick burning lamp, wherein the candle wick burning lamp includes a container and a candle wick structure, the candle wick structure including a candle wick body and a support base fixed with one end of the candle wick body, the support base being placed at a bottom of the container, the bottom of the container being in a circular structure; and the protective device includes a central portion and a branch portion, the branch portion being connected to the central portion, a length of the branch portion is 0.7 to 1 time a radius of the circular structure, at least two branch portions being arranged, the bottom of the container supporting the at least two branch portion, the at least two branch portions being arranged in a fashion of surrounding the central portion, at least one of the at least two branch portions and/or the central portion being provided with a through hole, the through hole allowing the candle wick body to pass through.

Another embodiment of the present disclosure further provide a candle wick burning lamp assembly, including a candle wick burning lamp and the protective device as described above.

DETAILED DESCRIPTION

For better understanding of the present disclosure, the present disclosure is described in detail with reference to attached drawings and specific embodiments. It should be noted that, when an element is defined as "being secured or fixed to" another element, the element may be directly positioned on the element or one or more centered elements may be present therebetween. When an element is defined as "being connected or coupled to" another element, the element may be directly connected or coupled to the element or one or more centered elements may be present therebetween. As used herein, the terms "vertical", "horizontal", "left", "right", "inner", "outer", and similar expressions are only for illustration purposes.

Unless otherwise defined, all technical and scientific terms used herein denote the meaning as commonly understood by a person skilled in the art throughout the specification. Additionally, the terms used in the specification of the present disclosure are merely for description the embodiments of the present disclosure, but are not intended to limit the present disclosure. As used herein, the term "and/or" in reference to a list of two or more items covers all of the following interpretations of the term: any of the items in the list, all of the items in the list and any combination of the items in the list.

Figure 1:
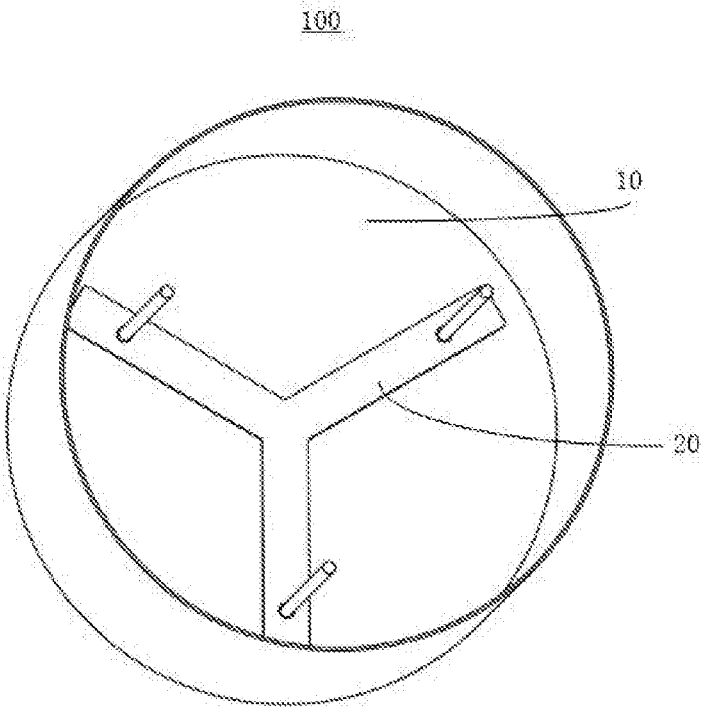
FIG. 1 is a schematic structural view of a candle wick burning lamp assembly according to an embodiment of the present disclosure.
Figure 2:
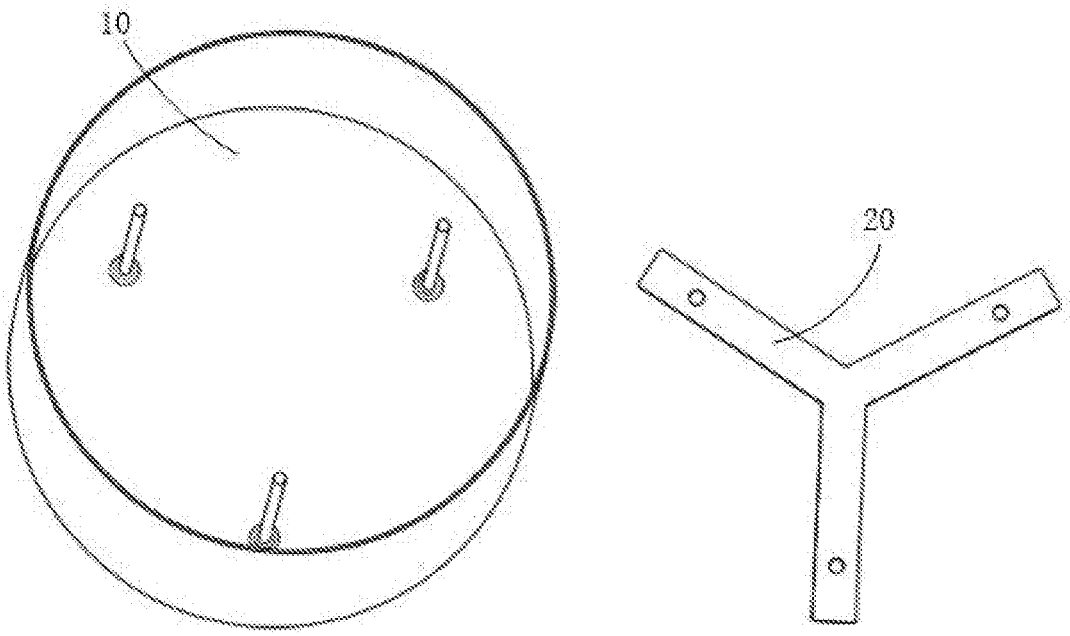
FIG. 2 is a schematic exploded view of the candle wick burning lamp assembly as illustrated in FIG. 1.

Referring to FIG. 1 and FIG. 2, a candle wick burning lamp assembly 100 according to an embodiment of the present disclosure is illustrated. The candle wick burning lamp assembly 100 includes a candle wick burning lamp 10 and a protective device 20. The protective device 20 is placed in the candle wick burning lamp 10.

Figure 3:
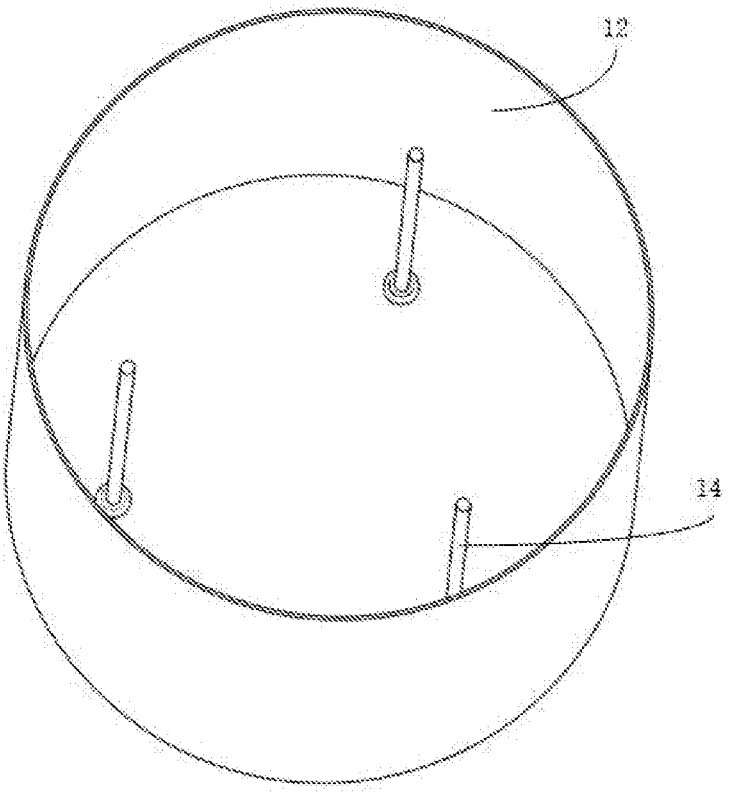
FIG. 3 is an entire structural view of a candle wick burning lamp in the candle wick burning lamp assembly as illustrated in FIG. 1.
Figure 4:
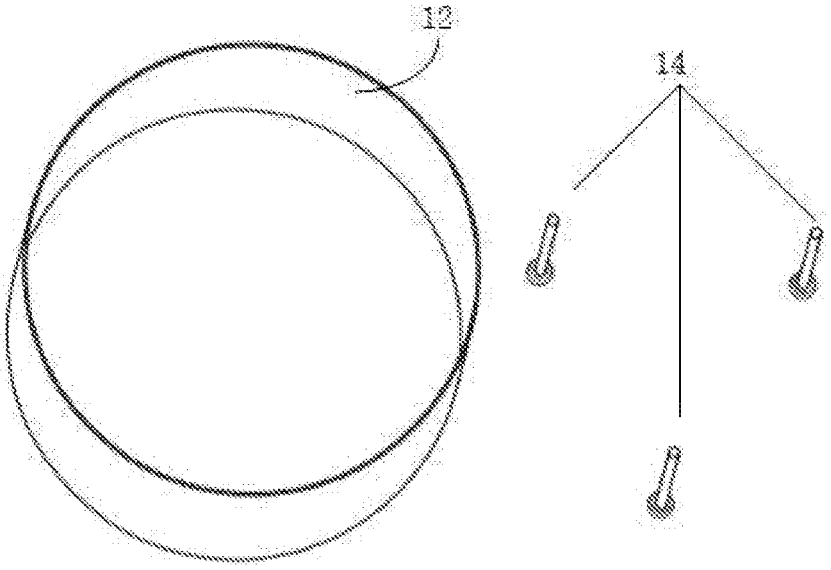
FIG. 4 is an exploded view of the candle wick burning lamp as illustrated in FIG. 3.

Referring to FIG. 3 and FIG. 4 together, the candle wick burning lamp 10 includes a container 12 and a candle wick structure 14. The candle wick structure 14 is placed in the container 12.

Figure 5:
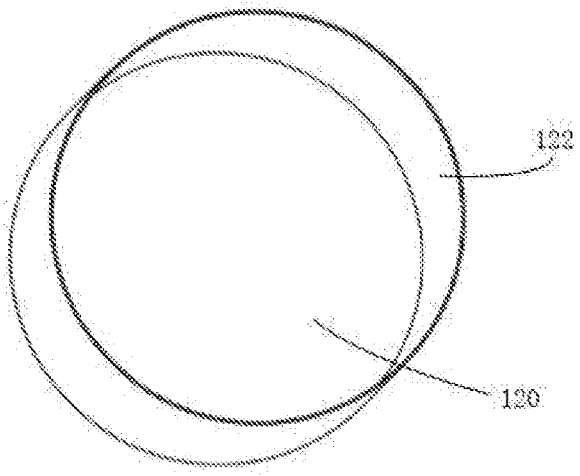
FIG. 5 is a schematic structural view of a container of the candle wick burning lamp as illustrated in FIG. 3.

Referring to FIG. 5 together, the container 12 may be made of a glass material, and is substantially in a frusto-conical structure. The container 12 includes a bottom 120 of the container and a side wall 122 of the container. The bottom 120 of the container is substantially in a circular structure. The side wall 122 of the container is substantially on a side of the bottom 120 of the container, and surrounds the bottom 120 of the container.

It may be understood that according to the actual needs, the container 12 may also be designed to a cylindrical structure.

Figure 6:
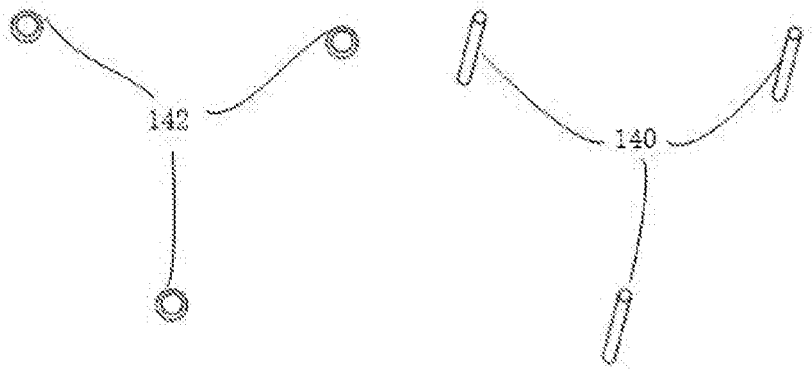
FIG. 6 is a schematic structural view of a candle wick body of the candle wick burning lamp as illustrated in FIG. 3.

Referring to FIG. 6 together, the candle wick structure 14 includes a candle wick body 140 and a support base 142. The candle wick body 140 is fixed to the support base 142. The candle wick body 140 may be made of a cotton rope, and substantially in an elongated stripe-like structure. One end of the candle wick body 140 is a burning end for burning, and the other end of the candle wick body 140 is fixed to the support base 142.

The support base 142 is substantially in a flat structure, and the support base 142 may be made of a metal material. The candle wick body 140 is fixed to a top of the support base 142. The support base 142 is placed at the bottom 120 of the container, and the support base 142 and the side wall 122 of the container are on the same side of the bottom 120 of the container, wherein a bottom of the support base 142 is in contact with the bottom 120 of the container.

In an embodiment of the present disclosure, the number of candle wick structures 14 is two.

In some embodiments of the present disclosure, the number of candle wick structures 14 is three. The three candle wick structures 14 are substantially arranged triangularly at the bottom 120 of the container.

In some other embodiments of the present disclosure, the number of candle wick structures 14 may be four, five, or seven. It should be noted that the number of candle wick structures 14 is not limited, and the number may even be greater or less.

Figure 7:
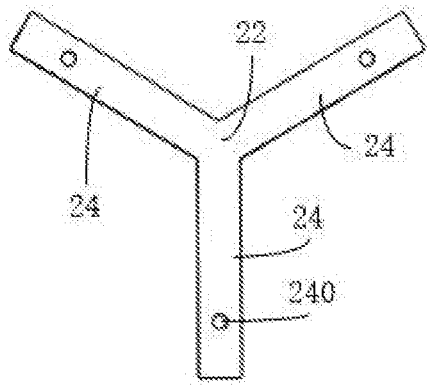
FIG. 7 is a schematic structural view of a protective device according to an embodiment of the present application.
Figure 8:
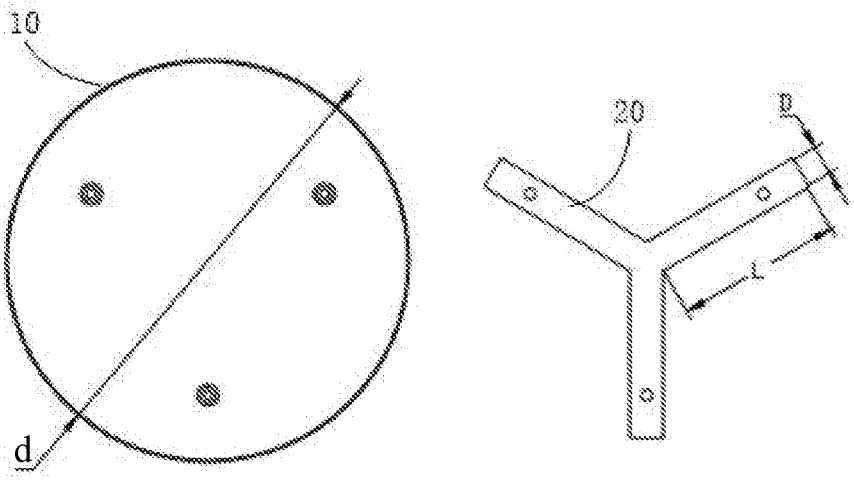
FIG. 8 is a top view of the protective device as illustrated in FIG. 7 and the candle wick burning lamp, wherein a relative proportion between the protective device and the candle wick burning lamp is mainly illustrated.

Referring to FIG. 7 and FIG. 8, a protective device 20 according to an embodiment of the present disclosure is illustrated. The protective device 20 is configured to be used with the candle wick burning lamp 10 as described above.

The protective device 20 is placed at the bottom 120 of the container, and the protective device 20 and the side wall 122 of the container are on the same side of the bottom 120 of the container, such that the support base 142 is fixed to the predetermined position of the bottom 120 of the container.

The protective device 20 may be made by stamping metal thin sheets, and is substantially in a sheet-like structure. The protective device 20 includes a central portion 22 and a branch portion 24. The branch portion 24 and the central portion 22 are integrally formed. The branch portion 24 is in a stripe shape, and one end of the branch portion is connected to the central portion 22. A length L of the branch portion 24 is substantially equal to a diameter d/2 of the circular structure, that is, the length L of the branch portion 24 is substantially equal to a radius of the circular structure.

A through hole 240 is opened at a middle waist position of the branch portion 24. A radius r of the through hole 240 is 1 to 1.5 times a radius of the candle wick body 140, which conveniently allows the candle wick body 140 to pass through the through hole 240, and better restrains the support base 142 to the predetermined position of the bottom 120 of the container.

It may be understood that according to the actual needs, a radius r of the through hole 240 may be defined to any value as long as the candle wick body 140 is allowed to pass therethrough.

A width D of the branch portion is 2 to 4 times the radius r of the through hole 240, such that it may be ensured that the branch portion 24 has a small size and has a sufficient strength, and hence the middle waist may be not easily subject to fracture due to the through hole 240 arranged in the middle waist position.

It may be understood that according to the actual needs, the width D of the branch portion 24 and the radius of the through hole 240 may be defined to any value as long as the through hole 240 is arranged in the middle waist position of the branch portion 24.

The number of branch portions 24 may be two. The two branch portions 24 are arranged in a fashion of surrounding the central portion 22, and define a 180-degree angle therebetween. The through holes of the two branch portions 24 are respectively passed through by two candle wick bodies 140. It should be noted that this embodiment is a preferred solution, and the angle defined between the two branch portions 24 may be defined to any value.

In some embodiments, the number of branch portions 24 is three. The three branch portions 24 are arranged in a fashion of surrounding the central portion 22, and the through holes 240 of the three branch portions 24 are respectively passed through by three candle wick bodies 140.

It may be understood that according to the actual needs, the number of candle wick structures 14 and the number of through holes 240 of the branch portions 24 are not limited to two or three. For example, the number may be even greater as long as at least one branch portion 24 is provided with the through hole 240. In addition, the through hole 240 may also be arranged in the central portion 22, in the case where the candle wick burning lamp 10 only includes one candle wick structure 14, only one through hole 240 may be provided in the central portion 22, and there is no need to provide a through hole 240 in the branch portion 24.

Hereinafter, description is given by taking a candle wick burning lamp assembly 100 constituted by a protective device 20 formed by three branch portions 24 and a central portion 22 and a candle wick burning lamp 10 in cooperation with the protective device 20 as an example.

The central portion 22 and the three branch portions 24 collaboratively form a Y-shaped structure.

When the protective device 20 is placed at the bottom 120 of the container, the through holes 240 of the three branch portions 24 are respectively aligned with burning ends of the three candle wick bodies 140, and the three branch portions 24 are respectively placed, along the three candle wick bodies 140, over the support bases 142 of the three candle wick bodies 140. The three branch portions 24 are respectively supported by the support bases 142 of the three candle wick bodies 140, that is, indirectly supported by the bottom 120 of the container.

It may be understood that according to the actual needs, the branch portion 24 may also be designed to have a specific curvature, such that a tail end of the branch portion 24 distal from the central portion 22 is bent towards the bottom 120 of the container relative to the middle waist position of the branch portion 24. In this way, the middle waist portion of the branch portion 24 is over the support base 142, and the tail end of the branch portion 24 is directly supported by the bottom 120 of the container. This only requires that the bottom 120 of the container supports the three branch portions 24.

The length L of the branch portion 24 is designed to be substantially equal to the radius of the circular structure, and the central portion 22 and the three branch portions 24 are substantially in a Y-shaped structure, such that when the protective device 20 is placed at the bottom 120 of the container, no matter what angle the bottom 120 of the container is at, the candle wick structures 14 is at the predetermined position more distal from the side wall 122 of the container.

It may be understood that according to the actual needs, the length L of the branch portion 24 may also be slightly less than the radius of the circular structure, as long as the length L of the branch portion 24 is 0.7 to 1 time the radius of the circular structure. In addition, according to the actual needs, the central portion 22 and the three branch portions 24 may also be collaboratively defined to other shapes, as long as it may be ensured that when the protective device 20 is placed at the bottom 120 of the container at any angle, the candle wick structures 14 are all at the predetermined position more distal from the side wall 122 of the container.

Figure 9:
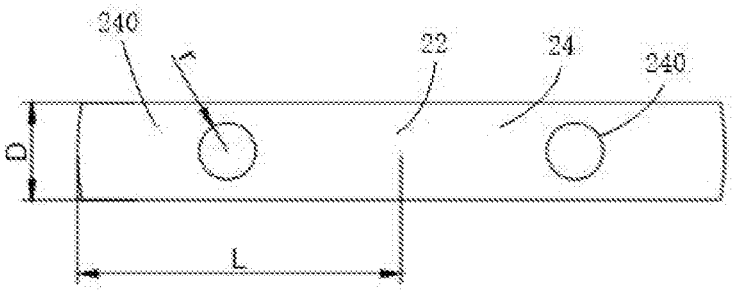
FIG. 9 is a schematic structural view of a protective device according to another embodiment of the present disclosure.

In an embodiment of the present disclosure, referring to FIG. 9, the number of branch portions 24 of the protective device 20 is two. One end of each of the two branch portions 24 distal from the central portion 22 is defined to an arc (not illustrated in the drawings), and the two branch portions 24 are both provided with the through hole 240. Specifically, the protective device 20 is arranged in a linear shape, the width D of the branch portion is 12 cm, the length L of the branch portion is 40 cm, a radius of the arc is 40 cm, the radius r of the through hole 240 is 3.5 cm, and a distance from each of the through holes 240 of the two branch portions 24 to the central portion 22 is 21.5 cm.

Figure 10:
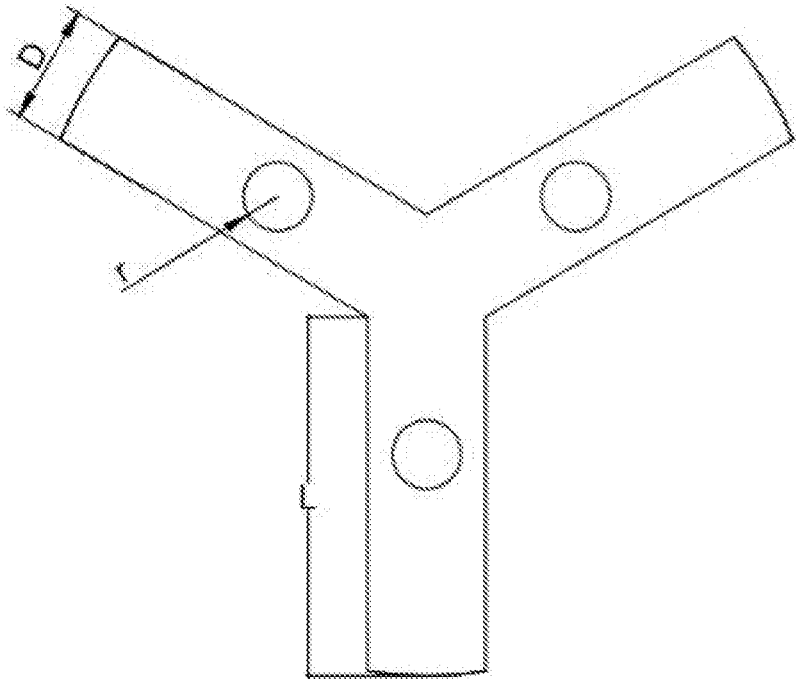
FIG. 10 is a schematic structural view of a protective device having three branch portions according to an embodiment of the present disclosure.

In some embodiments, referring to FIG. 10, the number of branch portions 24 of the protective device 20 is three. One end of each of the three branch portions 24 distal from the central portion 22 is defined to an arc (not illustrated in the drawings), and the three branch portions 24 are all provided with the through hole 240. Specifically, the protective device 20 is arranged in a Y shape, the angle defined between each two adjacent branch portions 24 is 120 degrees, the width D of the branch portion is 12 cm, the length L of the branch portion is 36.5 cm, the radius of the arc is 40 cm, the radius r of the through hole 240 is 3.5 cm, and the distance from each of the through holes 240 of the three branch portions 24 to the central portion 22 is 17.5 cm.

Figure 11:
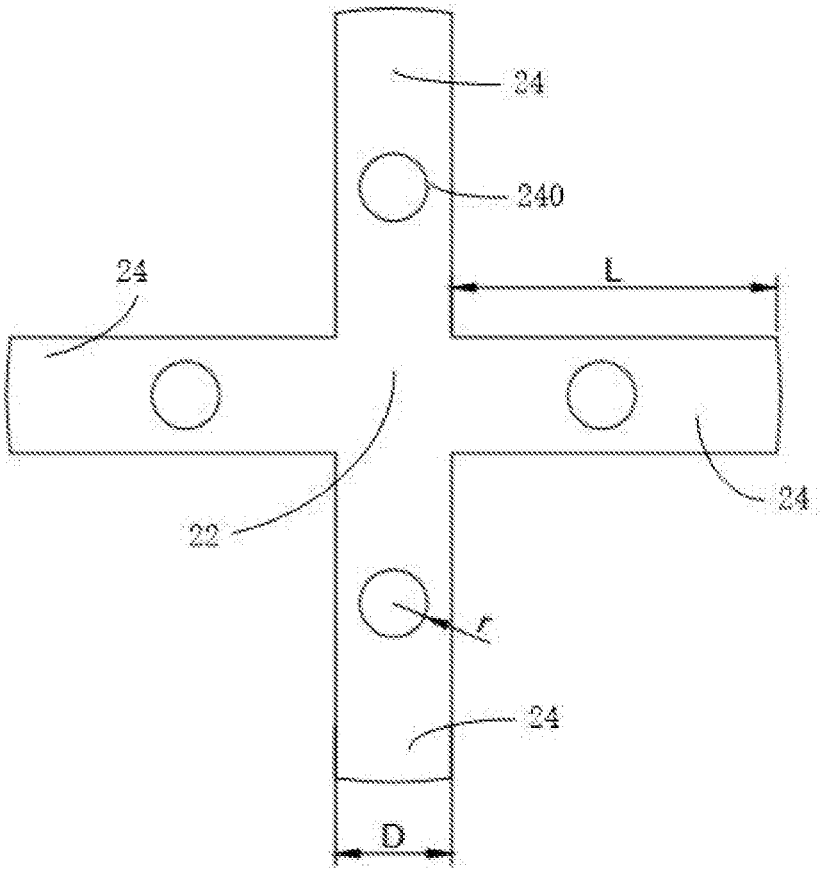
FIG. 11 is a schematic structural view of a protective device having four branch portions according to an embodiment of the present disclosure.

In some embodiments, referring to FIG. 11, the number of branch portions 24 of the protective device 20 is four. One end of each of the four branch portions 24 distal from the central portion 22 is defined to an arc (not illustrated in the drawings), and the four branch portions 24 are all provided with the through hole 240. Specifically, the protective device 20 is arranged in a cross shape, the angle defined between each two adjacent branch portions 24 is 90 degrees, the width D of the branch portion is 12 cm, the length L of the branch portion is 34 cm, the radius of the arc is 40 cm, the radius r of the through hole 240 is 3.5 cm, and the distance from each of the through holes 240 of the four branch portions 24 to the central portion 22 is 21.5 cm.

Figure 12:
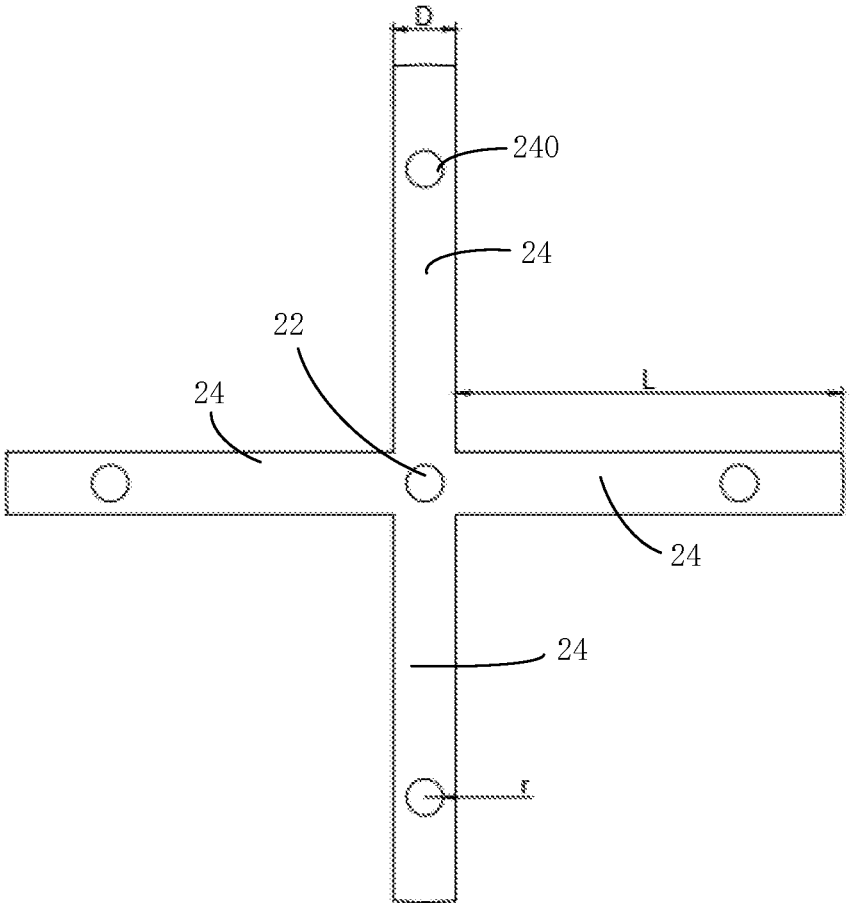
FIG. 12 is a schematic structural view of another protective device having four branch portions according to an embodiment of the present disclosure.

In some embodiments, referring to FIG. 12, the number of branch portions 24 of the protective device 20 is four. One end of each of the four branch portions 24 distal from the central portion 22 is defined to an arc (not illustrated in the drawings), and the four branch portions 24 and the central portion 22 are all provided with the through hole 240. Specifically, the protective device 20 is arranged in a cross shape, the angle defined between each two adjacent branch portions 24 is 90 degrees, the width D of the branch portion is 12 cm, the length L of the branch portion is 74 cm, the radius of the arc is 80 cm, the radius r of the through hole 240 is 3.5 cm, and the distance from each of the through holes 240 of the four branch portions 24 to the through hole 240 of the central portion 22 is 60 cm.

Figure 13:
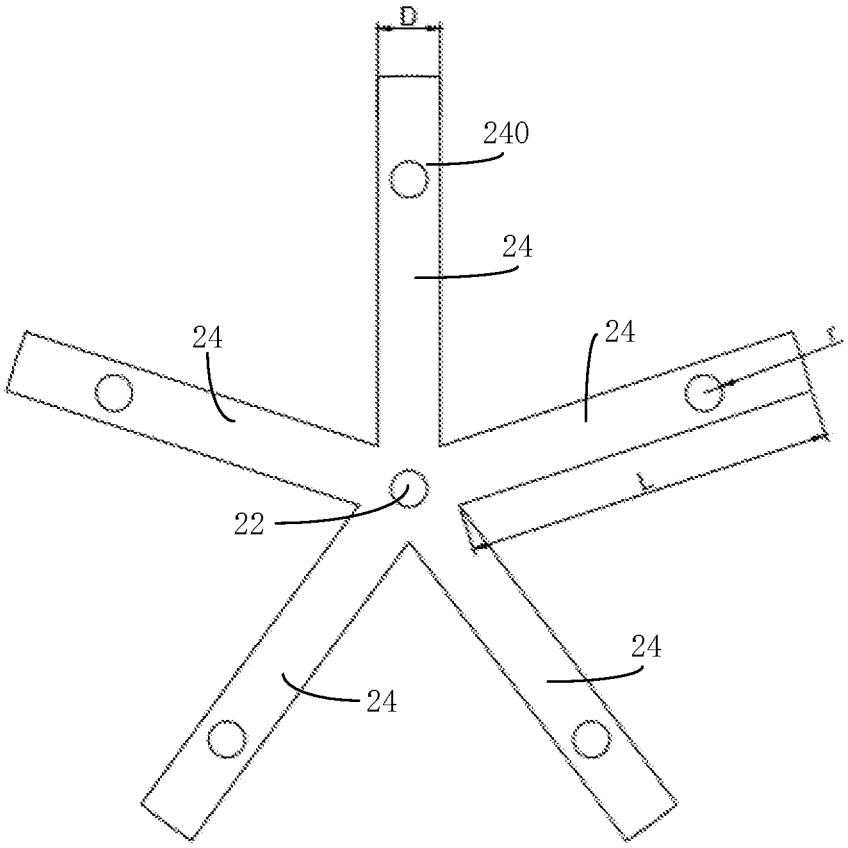
FIG. 13 is a schematic structural view of a protective device having five branch portions according to an embodiment of the present disclosure.

In some embodiments, referring to FIG. 13, the number of branch portions 24 of the protective device 20 is five. One end of each of the five branch portions 24 distal from the central portion 22 is defined to an arc (not illustrated in the drawings), and the five branch portions 24 and the central portion 22 are all provided with the through hole 240. Specifically, the angle defined between each two adjacent branch portions 24 is 72 degrees, the width D of the branch portion is 12 cm, the length L of the branch portion is 71.5 cm, the radius of the arc is 80 cm, the radius r of the through hole 240 is 3.5 cm, and the distance from each of the through holes 240 of the five branch portions 24 to the through hole 240 of the central portion 22 is 60 cm.

Figure 14:
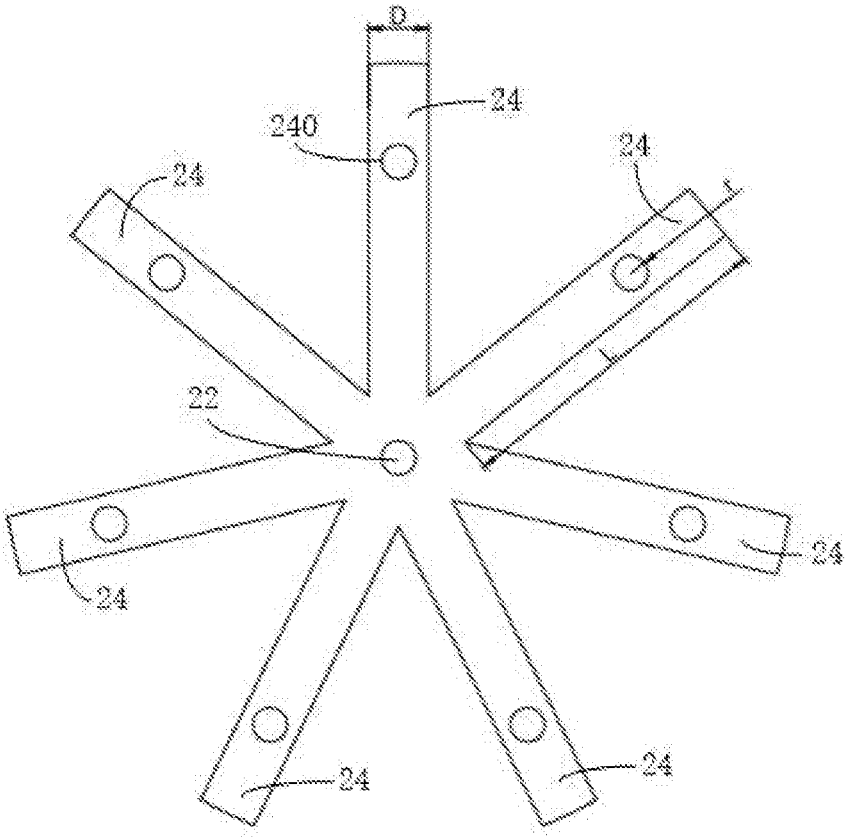
FIG. 14 is a schematic structural view of a protective device having seven branch portions according to an embodiment of the present disclosure.

In some embodiments, referring to FIG. 14, the number of branch portions 24 of the protective device 20 is seven. One end of each of the seven branch portions 24 distal from the central portion 22 is defined to an arc (not illustrated in the drawings), and the seven branch portions 24 and the central portion 22 are all provided with the through hole 240. Specifically, the seven branch portions 24 are evenly arranged with the central portion 22 as center, the width D of the branch portion is 12 cm, the length L of the branch portion is 67 cm, the radius of the arc is 80 cm, the radius r of the through hole 240 is 3.5 cm, and the distance from each of the through holes 240 of the seven branch portions 24 to the through hole 240 of the central portion 22 is 60 cm.

It may be understood that according to the actual needs, the number of branch portions 24 is not limited to the number disclosed in the above embodiments. However, the number of branch portions may be even greater, as long as at least two branch portions are arranged.

During use of the candle wick burning lamp assembly, the burning end of the candle wick body 140 is ignited, and the protective device 20 may maintain the candle wick body 140 at the predetermined position distal from the side wall 122 of the container, such that the burning end of the candle wick body 140 is prevented from contacting with the side wall 122 of the container.

During burning of the candle wick body 140, the burning end of the candle wick body 140 gradually approaches the protective device 20, and when the candle wick body 140 is substantially exhausted, the burning end of the candle wick body 140 approaches the branch portion 24. Since the protective device 20 is made of a metal material, the branch portion 24 may not be ignited by the exhausting candle wick body 140.

It may be understood that according to the actual needs, the branch portion 24 may also be made of a ceramic material or a fire retardant adhesive material, as long as the materials are flame retardant materials.

In addition, it should be noted that if the protective device 20 is made of the metal material, relative to other flame retardant materials, the metal material is easily machinable and has a low cost. Specifically, a metal thin sheet needs to be only stamped to form the protective device 20.

It may be understood that according to the actual needs, the protective device 20 may also be made of the metal material by other processes, for example, a casting process. In this case, the protective device 20 may also be in a non-sheet-like structure. The protective device 20 may also be made by machining by a sheet metal welding process. In this case, the central portion 22 and the branch portion 24 may also be connected in a non-integral-molding fashion, for example, by welding, riveting or the like.

As compared with the related art, in the protective device 20 and the candle wick burning lamp assembly 100 according to the present disclosure, the protective device 20 includes a central portion 22 and a branch portion 24. The branch portion 24 is connected to the central portion 22. A length of the branch portion 24 is 0.7 to 1 time a radius of the circular structure. At least two branch portions 24 are arranged. The at least two branch portions 24 are arranged in a fashion of surrounding the central portion 22. At least one of the at least two branch portions 22 is provided with a through hole 240. The through hole 240 allows the candle wick body 140 to pass through. When the protective device 20 is placed at the bottom 120 of the container, no matter at what angle the container is placed, the through hole 240 is at a predetermined position that is far away from the side wall 122 of the container, and the support base 142 is restrained at the predetermined position of the bottom 120 of the container by the candle wick body 140.

Described above are exemplary embodiments of the present disclosure, but are not intended to limit the scope of the present disclosure. Any equivalent structure or equivalent process variation made based on the specification and drawings of the present disclosure, which is directly or indirectly applied in other related technical fields, fall within the scope of the present disclosure.

What is claimed is:

1. A protective device for a candle wick burning lamp, wherein the candle wick burning lamp comprises a container and a candle wick structure, the candle wick structure comprising a candle wick body and a support base fixed with one end of the candle wick body, the support base being placed at a bottom of the container, the bottom of the container being in a circular structure; and the protective device comprises a central portion and a branch portion, the branch portion being connected to the central portion, a length of the branch portion being 0.7 to 1 time a radius of the circular structure, at least two branch portions being arranged, the bottom of the container supporting the at least two branch portion, the at least two branch portions being arranged in a fashion of surrounding the central portion, at least one of the at least two branch portions and/or the central portion being provided with a through hole, the through hole allowing the candle wick body to pass through.

2. The protective device according to claim 1, wherein the branch portion is made of a flame retardant material.

3. The protective device according to claim 2, wherein the branch portion is made of a metal material.

4. The protective device according to claim 3, wherein the branch portion and the central portion are integrally formed.

5. The protective device according to claim 4, wherein the at least two branch portions and the central portion collaboratively define a sheet-like structure.

6. The protective device according to claim 1, wherein the at least two branch portions are each provided with the through hole.

7. The protective device according to claim 6, wherein the through hole is opened at a middle waist position of the branch portion.

8. The protective device according to claim 7, wherein tail ends of the at least two branch portions distal from the central portion are each bent towards the bottom of the container relative to the middle waist position of the branch portion.

9. The protective device according to claim 1, wherein a radius of the through hole is 1 to 1.5 times a radius of the candle wick body.

10. The protective device according to claim 9, wherein a width of the branch is 2 to 4 times an aperture of the through hole.

11. A candle wick burning lamp assembly, comprising a candle wick burning lamp and a protective device, wherein the candle wick burning lamp comprises a container and a candle wick structure, the candle wick structure comprising a candle wick body and a support base fixed with one end of the candle wick body, the support base being placed at a bottom of the container, the bottom of the container being in a circular structure; and the protective device comprises a central portion and a branch portion, the branch portion being connected to the central portion, a length of the branch portion being 0.7 to 1 time a radius of the circular structure, at least two branch portions being arranged, the bottom of the container supporting the at least two branch portion, the at least two branch portions being arranged in a fashion of surrounding the central portion, at least one of the at least two branch portions and/or the central portion being provided with a through hole, the through hole allowing the candle wick body to pass through.

12. The candle wick burning lamp assembly according to claim 11, wherein the branch portion is made of a flame retardant material.

13. The candle wick burning lamp assembly according to claim 12, wherein the branch portion is made of a metal material, and the branch portion and the central portion are integrally formed.

14. The candle wick burning lamp assembly according to claim 11, wherein the at least two branch portions are each provided with the through hole, and the through hole is opened at a middle waist position of the branch portion.

15. The candle wick burning lamp assembly according to claim 14, wherein the at least two branch portions and the central portion collaboratively define a sheet-like structure;

or, tail ends of the at least two branch portions distal from the central portion are each bent towards the bottom of the container relative to the middle waist position of the branch portion.

16. The candle wick burning lamp assembly according to claim 15, wherein a number of branch portions of the protective device is three, and an angle defined between each two adjacent branch portions is 120 degrees.

17. The candle wick burning lamp assembly according to claim 15, wherein a number of branch portions of the protective device is four, and an angle defined between each two adjacent branch portions is 90 degrees.

18. The candle wick burning lamp assembly according to claim 15, wherein a number of branch portions of the protective device is five, and an angle defined between each two adjacent branch portions is 72 degrees.

19. The candle wick burning lamp assembly according to claim 15, wherein a number of branch portions of the protective device is seven, and the seven branch portions are evenly arranged with the central portion as center.

20. The candle wick burning lamp assembly according to claim 11, wherein a radius of the through hole is 1 to 1.5 times the radius of the candle wick body;

a width of the branch is 2 to 4 times an aperture of the through hole.

* * * * *